US007478894B2

(12) United States Patent
Kim et al.

(10) Patent No.: US 7,478,894 B2
(45) Date of Patent: Jan. 20, 2009

(54) METHOD OF CALIBRATING PRINT ALIGNMENT ERROR

(75) Inventors: Hyoung-il Kim, Suwon-si (KR); Kyung-pyo Kang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 955 days.

(21) Appl. No.: 10/759,109

(22) Filed: Jan. 20, 2004

(65) Prior Publication Data

US 2004/0160468 A1 Aug. 19, 2004

(30) Foreign Application Priority Data

Feb. 14, 2003 (KR) ..... 10-2003-0009413

(51) Int. Cl.
*B41J 29/393* (2006.01)
*B41J 29/38* (2006.01)

(52) U.S. Cl. ..... 347/19; 347/12

(58) Field of Classification Search ..... None
See application file for complete search history.

(56) References Cited

U.S. PATENT DOCUMENTS

| | | | | |
|---|---|---|---|---|
| 5,796,414 | A | 8/1998 | Sievert et al. | 347/19 |
| 6,345,876 | B1 * | 2/2002 | Tanaka et al. | 347/19 |
| 6,478,401 | B1 | 11/2002 | King et al. | 347/19 |
| 6,611,631 | B1 * | 8/2003 | Blair et al. | 382/296 |
| 7,032,988 | B2 * | 4/2006 | Darby et al. | 347/14 |
| 2002/0135629 | A1 | 9/2002 | Sarmast et al. | |
| 2003/0007023 | A1 * | 1/2003 | Barclay et al. | 347/8 |
| 2003/0164955 | A1 * | 9/2003 | Vinas et al. | 358/1.2 |

FOREIGN PATENT DOCUMENTS

| | | |
|---|---|---|
| EP | 1176802 A2 | 1/2002 |
| EP | 1 211 084 A1 | 6/2002 |
| EP | 1245399 A2 | 10/2002 |
| JP | 04-363277 | 12/1992 |
| JP | 10-58765 | 3/1998 |
| JP | 2001232775 | 8/2001 |
| JP | 2002146051 | 5/2002 |

OTHER PUBLICATIONS

European search report for European application No. EP 04 25 0798, date unknown.
Notice to submit Response and Office Action of the Korean Application 2003-9413.
Chinese Application No. 200410004146X issued Nov. 11, 2005; Chinese Office Action.

* cited by examiner

*Primary Examiner*—Twyler L. Haskins
*Assistant Examiner*—Marcus T Riley
(74) *Attorney, Agent, or Firm*—Stanzione & Kim, LLP

(57) ABSTRACT

A print alignment error between a first printhead of a first ink cartridge and a second printhead of a second ink cartridge installed in an inkjet printer is calibrated by printing preset test patterns on a paper according to an input correction signal using the first and second printheads, scanning the printed test patterns, measuring positions of a starting point and an end point of each of the scanned test patterns, calculating a horizontal print alignment error between the first and second printheads from the starting points, calculating a vertical print alignment error between the first and second printheads from the starting points and the end points, and calibrating the calculated horizontal and vertical print alignment errors.

5 Claims, 5 Drawing Sheets

METHOD OF CALIBRATING PRINT ALIGNMENT ERROR

CROSS-REFERENCE TO RELATED APPLICATIONS

This application claims the priority of Korean Patent Application No. 2003-9413 filed on Feb. 14, 2003 in the Korean Intellectual Property Office, the disclosure of which is incorporated herein in its entirety by reference.

BACKGROUND OF THE INVENTION

1. Field of the Invention

The present invention relates to an apparatus and a method of calibrating a print alignment error in an inkjet printer, and more particularly, to an apparatus and a method of calibrating a print alignment error between printheads of two ink cartridges in an inkjet printer.

2. Description of the Related Art

In general, an inkjet printer, in particular, a color inkjet printer, uses two or more ink cartridges. Accordingly, when an image is printed, an alignment error of an image may be generated due to an alignment error of a printhead of the ink cartridge. The alignment error of an image can be divided into a vertical alignment error and a horizontal alignment error.

The vertical and horizontal alignment errors are generated since nozzles of the printhead are not uniformly arranged and an error occurs in an apparatus for reciprocating an inkjet cartridge in a direction perpendicular to a paper path direction in which print paper is transferred.

A conventional method of calibrating the alignment error is shown in FIGS. 1A and 1B. Referring to FIG. 1, while an ink cartridge is moved in one direction, a test pattern having lines, of which intervals are set to increase or decrease at a regular pace, is printed on a paper where a reference pattern having lines at the same interval is already printed. A user selects one of the lines of the test pattern which is most aligned with a corresponding one of the lines of the reference pattern. Then, the number of the selected test pattern line and the number of the reference pattern line corresponding thereto are input to a manual calibration apparatus. A length between a reference line and the selected test pattern line is compared to a length between the reference line and the selected reference pattern line so that a horizontal alignment error is measured and calibrated. In FIG. 1A, the line 6 of the reference pattern and the line 6 of the test pattern are most aligned.

Referring to FIG. 1B, while a feeding roller is moved, a test pattern having lines, of which intervals are set to increase or decrease at a regular pace from a reference line, for example, a uppermost line of the test pattern, is printed on a paper where a reference pattern having lines at the same interval has been already printed in a vertical direction. The user selects one of the lines of the test pattern which is most aligned with a corresponding one of the lines of the reference pattern. Then, the number of the selected test pattern line and the number of the reference pattern line corresponding thereto are input to the manual calibration apparatus. A length between a reference line and the selected test pattern line is compared to a length between the reference line and the selected reference pattern line so that a vertical alignment error is measured and calibrated. In FIG. 1B, the line 6 of the reference pattern and the line 6 of the test pattern are most aligned.

However, in the conventional technology, the user needs to check a position of each line to confirm an alignment state of the test pattern. Thus, since the confirming of the alignment state of the lines of the test pattern is dependent on a visual ability of the user, a misaligned line may be selected. Also, only when the reference line of the test pattern matches the reference line of the reference pattern, calibration is possible. Furthermore, in the above method, a high resolution optical sensor is required to adopt a method of automatically calibrating alignment by using an optical sensor.

SUMMARY OF THE INVENTION

To solve the above and/or other problems, the present invention provides a method of calibrating a print alignment error in an inkjet printer having two or more ink cartridges by automatically measuring and calibrating vertical and horizontal print alignment errors occurring due to the ink cartridges, using an optical sensor.

Additional aspects and/or advantages of the invention will be set forth in part in the description which follows and, in part, will be obvious from the description, or may be learned by practice of the invention.

The foregoing and/or other aspects of the present invention may be achieved by providing a method of calibrating a print alignment error between a first printhead of a first ink cartridge and a second printhead of a second ink cartridge installed in an inkjet printer, the method comprising printing a plurality of preset test patterns on a paper according to an input correction signal by using the first and second printheads, scanning the printed test patterns, measuring positions of a starting point and an end point of each of the scanned test patterns, calculating a horizontal print alignment error between the first and second printheads from starting points of the scanned test patterns, calculating a vertical print alignment error between the first and second printheads from the starting points and the end points of the scanned test patterns, and calibrating the calculated horizontal and vertical print alignment errors.

According to another aspect of the invention, a shape of the test patterns comprises a rectangle and a right triangle having the same height as the rectangle, and one side of the triangle having the same height as a vertical side of the rectangle is connected to the vertical side of the rectangle.

According to yet another aspect of the invention the operation of scanning the printed test patterns is performed by an optical sensor attached to a carriage where the ink cartridges are installed.

According to still another aspect of the invention, the measuring the positions of the starting point and the end point comprises detecting the positions of the starting point and the end point of the test patterns by reading scales of an encoder strip corresponding to the positions of the starting and end prints where a line scanned by the optical sensor crosses the test patterns, using a linear encoder sensor installed on the carriage.

According to still yet another aspect of the invention, the operation of calculating the horizontal print alignment error comprises subtracting the starting point of a first test pattern by a first ink cartridge from the starting point of a second test pattern by a second ink cartridge, and calculating the horizontal print alignment error from a difference between a value, which is calculated in the operation of subtracting the starting point of the first test pattern from the starting point of the second test pattern, and a preset distance between the first test pattern and the second test pattern.

According to another aspect of the invention, the operation of calculating the vertical print alignment error comprises calculating a width W2_tri of a second triangle by subtracting the starting point from the end point of the second test pattern by the second ink cartridge, calculating a height H2 of the second triangle using Equation 1 from the width W2_tri and a preset angle θ facing the width W2-tri of the second triangle $$H2=W2_tri/\tan\theta \quad \text{[Equation 1];}$$

calculating a width W1_tri of a first triangle by subtracting the starting point from the end point of the first test pattern by the first ink cartridge, calculating a height H1 of the first triangle using Equation 2 from the width W1_tri and a preset angle θ facing the width W1-tri of the first triangle $$H1=W1_tri/\tan\theta \quad \text{[Equation 2];}$$

and calculating the vertical print alignment error by subtracting the height H1 of the first triangle from the height H2 of the second triangle.

According to another aspect of the invention, the operation of calculating the vertical print alignment error comprises calculating the width W2_tri of the second triangle by subtracting the starting point and a preset width of the rectangle from the end point of the second test pattern by the second ink cartridge, calculating the height H2 of the second triangle using Equation 3 from the width W2_tri and a preset angle θ facing the width W2-tri of the second triangle $$H2=W2_tri/\tan\theta \quad \text{[Equation 3];}$$

calculating the width W1_tri of the first triangle by subtracting the starting point and a preset width of the rectangle from the end point of the first test pattern by the first ink cartridge, calculating a height H1 of the first triangle using Equation 4 from the width W1_tri and a preset angle θ facing the width W2-tri of the first triangle $$H1=W1_tri/\tan\theta \quad \text{[Equation 4],}$$

and calculating the vertical print alignment error by subtracting the height H1 of the first triangle from the height H2 of the second triangle.

According to another aspect of the invention, the operation of printing preset test patterns comprises printing n units of first test patterns using the first printhead and then n units of second test patterns using the second printhead in the same swath, and the operation of calculating the vertical print alignment error comprises calculating an average vertical print alignment error with respect to n pairs of the first and second test patterns by repeating the operations of calculating the width W2_tri of the second triangle, calculating the height H2 of the second triangle, calculating the width W1_tri of the first triangle, calculating the height H1 of the first triangle, and calculating the vertical print alignment error.

According to another aspect of the invention, in the operation of printing the preset test patterns, the operation of calculating the vertical print alignment error comprises calculating an average vertical print alignment error with respect to n pairs of the first and second test patterns by repeating the operations of calculating the width W2_tri of the second triangle, calculating the height H2 of the second triangle, calculating the width W1_tri of the first triangle, calculating the height H1 of the first triangle, and calculating the vertical print alignment error.

According to another aspect of the invention, the operation of calibrating the calculated horizontal and vertical print alignment errors comprises calibrating a print position from the second ink cartridge with respect to the first ink cartridge.

According to another aspect of the invention, the operation of calibrating the calculated horizontal and vertical print alignment errors comprises adjusting a time to eject ink from nozzles of the second ink cartridge to calibrate the horizontal print alignment error, and moving the position of a print file printed by nozzles of the second ink cartridge to correspond to the horizontal print alignment error to calibrate the horizontal print alignment error.

According to another aspect of the invention, the operation of calibrating the calculated horizontal and vertical print alignment errors comprises moving the position of a print file printed by nozzles of the second ink cartridge to correspond to the vertical print alignment error to calibrate the vertical print alignment error.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1A:
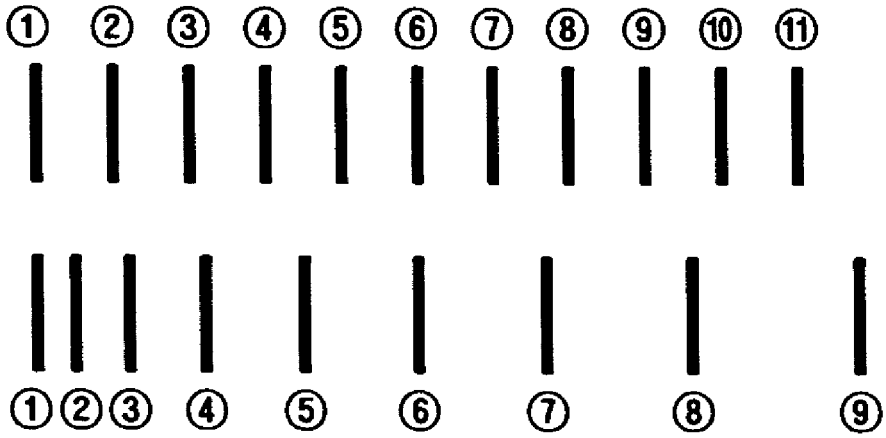
FIG. 1A (PRIOR ART)
FIGS. 1A and 1B are views illustrating conventional test patterns to check a print alignment error.
Figure 1B:
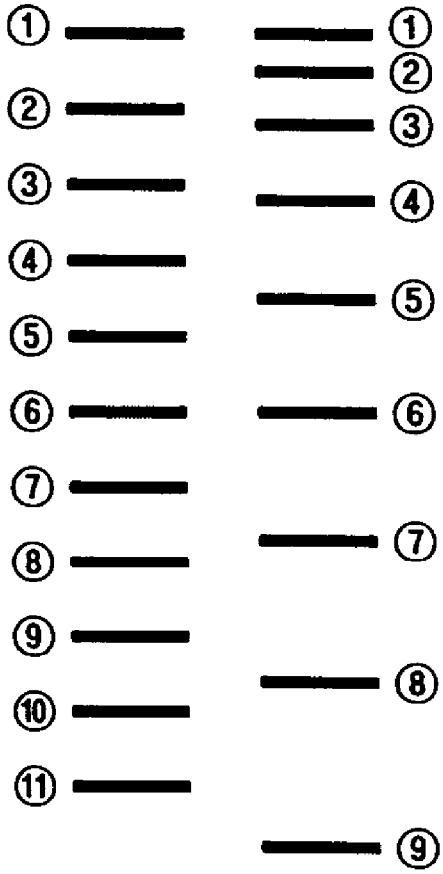
FIG. 1B (PRIOR ART)

Reference will now be made in detail to the embodiment of the present invention, examples of which are illustrated in the accompanying drawing 1, wherein like reference numerals refer to the like element 1 throughout. The embodiments are described below in order to explain the present invention by referring to the figures.

Figure 2:
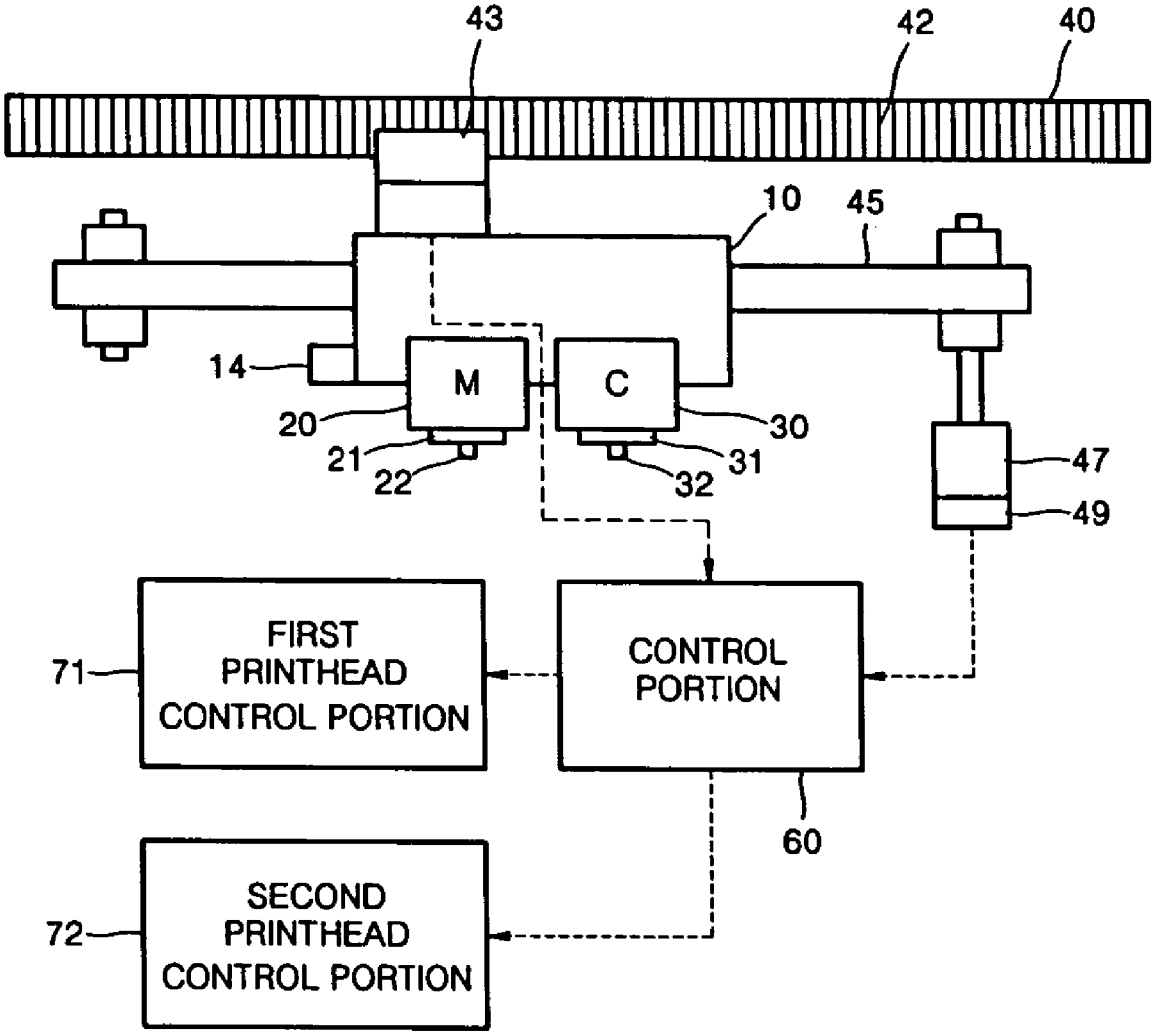
FIG. 2 is a view partially illustrating a structure of an inkjet printer performing a method of calibrating a print alignment error in an inkjet printer according to an embodiment of the present invention.

FIG. 2 shows a view illustrating a structure of an inkjet printer performing a method of calibrating a print alignment error according to an embodiment of the present invention. Referring to FIG. 2, the inkjet printer includes a carriage 10 running in a printing (scanning) direction Y perpendicular to a paper path direction X in which paper is transferred and disposed above a platen (not shown) where the paper is placed. A plurality of ink cartridges 20 and 30 (two ink cartridges shown in FIG. 2) are mounted on the carriage 10 in parallel. Printheads 21 and 31 having a plurality of nozzles 22 and 32 are arranged in a lower portion of each of the ink cartridges 20 and 30. The two ink cartridges 20 and 30 are, for example, mono and color ink cartridges M and C. An encoder strip 40 in a linear scale is arranged in the direction Y by being separated by a predetermined distance from the cartridges 20 and 30. A plurality of straight scale marks 42 spaced at the same interval are printed on the encoder strip 40. A linear encoder sensor 43 detecting a position of the carriage 10 running in the direction Y is provided on the carriage 10. The linear encoder sensor 43 transmits a pulse signal generated when the linear encoder sensor 43 passes the straight scale marks 42 of the encoder strip 40 with the carriage 10, to a control portion 60.

An optical sensor 14 detecting an image of the paper on the platen 0 is provided on the carriage 10 to move together with the carriage 10. The carriage 10 is fixed to a circulation belt 45, and a rotary encoder 49 is connected to a rotation shaft of a motor 47 to drive the circulation belt 45.

The control portion 60 calculates an alignment error from the measured data and transmits signals corresponding to the measured data to control a first printhead control portion 71 and a second printhead control portion 72.

Figure 3:
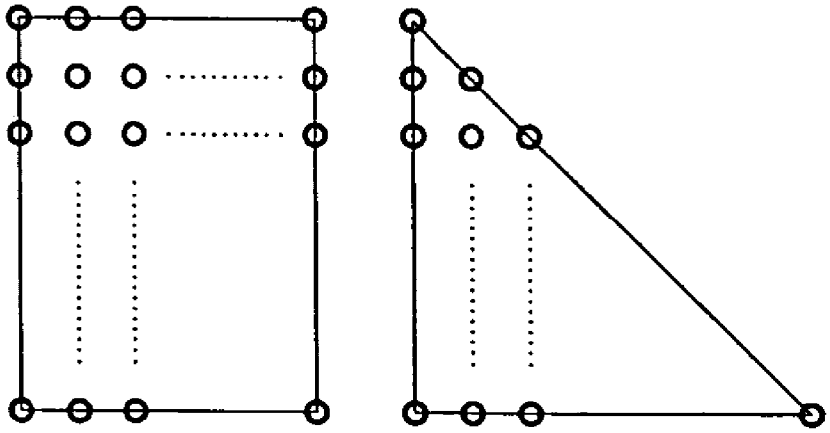
FIG. 3 is a view illustrating an example of a test pattern used in a method of calibrating a print alignment error in an inkjet printer according to another embodiment of the present invention.

FIG. 3 shows a view illustrating an example of a test pattern used in a method of calibrating a print alignment error in an inkjet printer according to another embodiment of the present invention. Referring to FIGS. 2 and 3, a test pattern is made of a combination of a predetermined quadrangular shape and a predetermined triangular shape which are printed on the paper using ink from the nozzles 22 and 23 of the respective printheads 21 and 31. In the present invention, a vertical and horizontal alignment method using the triangular test pattern is disclosed. The quadrangular shape is to facilitate a measurement of the optical sensor 14. That is, in a conventional technology, a line is detected to be used in alignment so that a highly sensitive optical sensor 14 is needed to detect the line, which imposes a financial burden. In the present invention, since a width of a quadrangular pattern exists, the highly sensitive optical sensor is not needed, unlike with the conventional technology.

The test pattern is preferably formed within a single swath so that it is formed by one time running of the ink cartridge 10. The test pattern includes a plurality of lines parallel to each other in the quadrangular and triangular shapes which have a common side perpendicular to the printing or scanning direction. Each line may be formed with a plurality of ink dots disposed adjacent to each other. The lines have different lengths in the printing or scanning direction.

Figure 4:
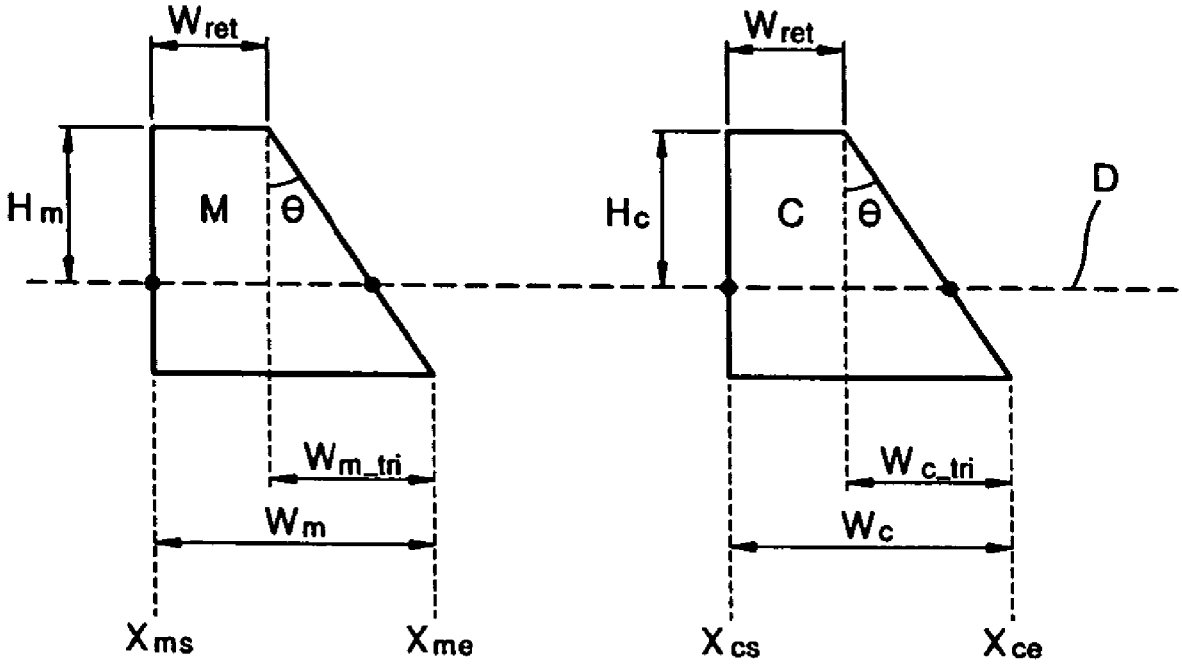
FIG. 4 is a view illustrating a method of measuring an alignment state of the test pattern of FIG. 3 according to another embodiment of the present invention.
Figure 5:
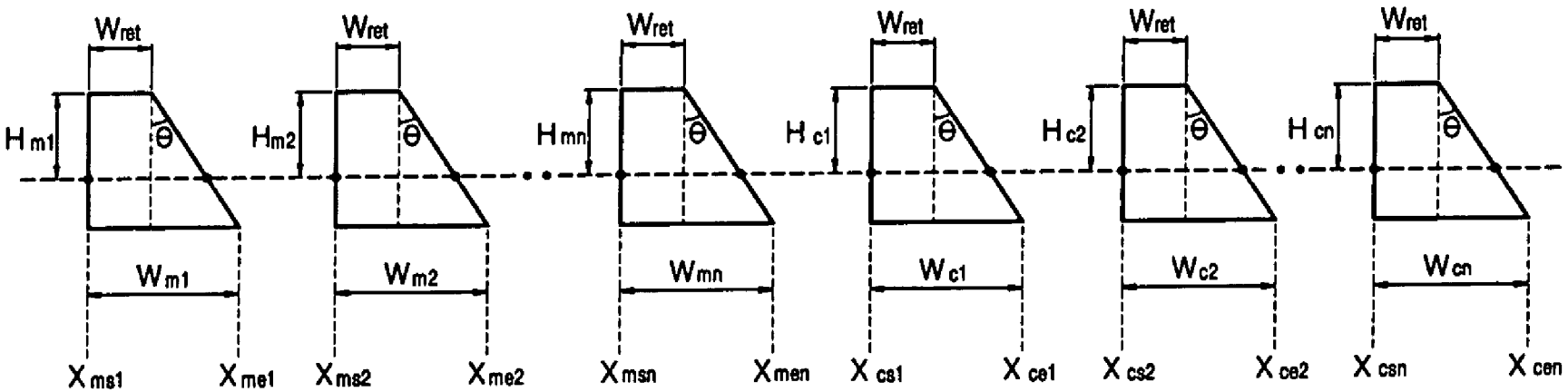
FIG. 5 is a view illustrating a method of measuring an average horizontal alignment error and a vertical alignment error according to another embodiment of the present invention.

FIG. 4 shows a method of calibrating an alignment state of the test pattern of FIG. 3. FIG. 5 shows a method of measuring an average horizontal alignment error and a vertical alignment error according to another embodiment of the present invention.

Referring to FIGS. 2 through 4, a mono test pattern M and a color test pattern C corresponding thereto are printed on the paper. While the carriage 10 runs over the printed patterns M and C, starting points Xms and Xcs where a dotted line D read by the optical sensor 14 and the test patterns M and C cross are measured by using the encoder sensor 43 and the optical sensor 14 attached to the carriage 10. A distance between the patterns is measured by subtracting the position of the starting point Xms of the mono test pattern M from the starting point Xcs of the color test pattern C. The measured distance is Xcs−Xms. When reference starting points of the mono test pattern M and the color test pattern C are set to Sms and Scs, respectively, a horizontal print alignment error Eh from the nozzles 22 and 32 of the respective printheads 21 and 31 of the mono ink cartridge 20 and the color ink cartridge 30 is represented by Equation 1.

$$Eh=(Scs-Sms)-(Xcs-Xms) \quad \text{[Equation 1]}$$

Referring to FIG. 5, n units of mono test patterns M and n units of color test patterns C are printed to correspond to each other. A horizontal alignment error between the color test pattern C and a corresponding mono test pattern M is calculated using the same method as Equation 1. Thus, an average obtained by calculating the respective horizontal alignment errors between the n pairs of the color test pattern C and the mono test pattern M is expressed by Equation 2.

$$Eh_{ave}=\frac{\sum_{i=1}^{n}(Scsi-Smsi)-(Xcsi-Xmsi)}{n} \quad \text{[Equation 2]}$$

Next, a method of obtaining a vertical alignment error is described below.

Referring to FIGS. 2 through 4, as described above, the mono test pattern M and the color test pattern C are printed at a predetermined interval. While the carriage 10 runs over the printed patterns M and C, starting points Xms and Xcs and end points Xme and Xce where the dotted line D crosses the respective test patterns M and C are read and measured by the optical sensor 14 using the pulse signal read by the encoder sensor 43. Widths Wm and Wc where the respective test patterns M and C and the dotted line D, which is scanned by the optical sensor, are calculated by subtracting the starting points Xms and Xcs from the end points Xme and Xce of the respective test patterns M and C. By subtracting a predetermined width Wret of the quadrangle from the widths Wm and Wc, widths Wm_tri and Wc_tri of the triangles formed in the respective test patterns M and C crossing the dotted line D, are calculated using Equation 3.

$$Wm=Xme-Xms,\ Wc=Xce-Xcs$$

$$Wm_tri=Wm-Wret,\ Wc_tri=Wc-Wret \quad \text{[Equation 3]}$$

Also, since one angle θ of a triangle of each test pattern M or C is preset, a height of the triangle from the scanned dotted line is obtained by Equation 4.

$$Hm=Wm_tri/\tan\theta$$

$$Hc=Wc_tri/\tan\theta \quad \text{[Equation 4]}$$

Thus, the vertical alignment errors of the mono test pattern M and the color test pattern C are expressed as in Equation 5.

$$Ev=Hc-Hm=(Wc_tri-Wm_tri)/\tan\theta \quad \text{[Equation 5]}$$

Referring to FIG. 5, the n units of the mono test patterns M and the n units of the color test patterns C are printed to correspond to each other. A vertical alignment error between the color test pattern C and a corresponding mono test pattern M is calculated using the same method as Equation 5. Thus, an average obtained by calculating the respective vertical alignment errors between the n pairs of the color test pattern C and the mono test pattern M is expressed by Equation 6.

$$Ev_{ave}=\frac{\sum_{i=1}^{n}(Wci_{tri}-Wmi_{tri})/\tan\theta}{n} \quad \text{[Equation 6]}$$

The method of calibrating a print alignment error in an inkjet printer according to another embodiment of the present invention will now be described in detailed hereinafter with reference to the accompanying drawings.

Figure 6:
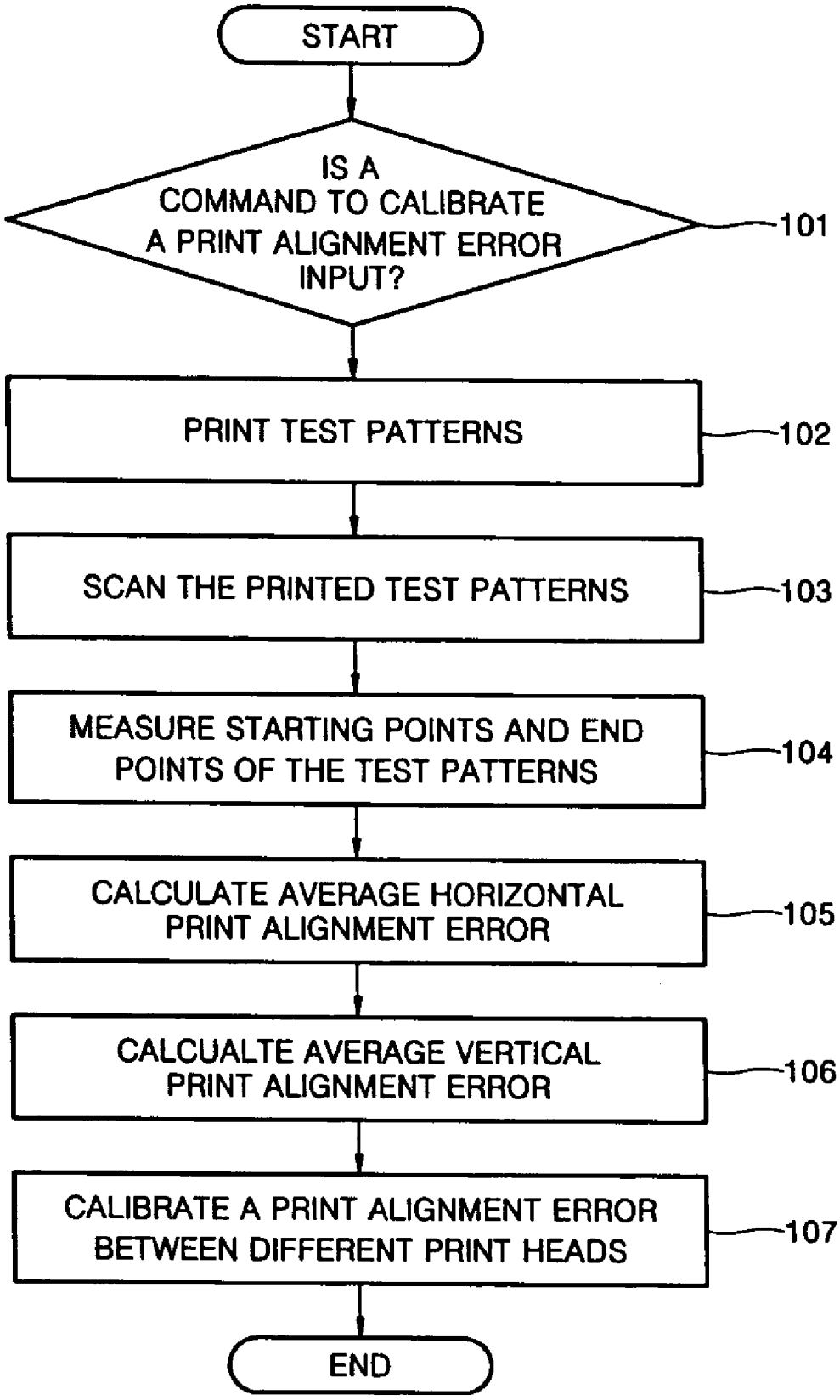
FIG. 6 is a flow chart explaining a method of calibrating a print alignment error in an inkjet printer according to another embodiment of the present invention.

FIG. 6 is a flow chart illustrating a method of calibrating a print alignment error in an inkjet printer according to another embodiment of the present invention.

Referring to FIGS. 2 through 6, in a printer having the two ink cartridges 20 and 30, it is checked whether a command to calibrate a print alignment error between the two ink cartridges 20 and 30 is input from an external source to the control portion 60 in operation 101.

When the command to calibrate the print alignment error is input in operation 101, a preset test pattern, test patterns corresponding to each other, are printed on paper by using the ink cartridges 20 and 30 in operation 102. That is, n units of the mono test pattern M are printed and then n units of the color test pattern C are printed on the same swath of the paper. The shapes of the mono and color test patterns M and C are preferably trapezoidal in which one side is rectangular and the other side is triangular.

Next, while the carriage 10 moves in the direction Y, the printed test patterns M and C are scanned by the optical sensor 14 attached to the carriage 10 in operation 103. The scale mark 42 of the encoder strip 40 are measured by the linear encoder sensor 43 to detect the position of the carriage 10 moving along the printing (scanning) direction with respect to the encoder strip 40. That is, a pulse signal generated when the encoder sensor 43 passes each scale mark 42 of the encoder strip 40 is transmitted to the control portion 60.

The control portion 60 compares the number of pulses detected by the encoder sensor 43 and the starting points Xms and Xcs and the end points Xme and Xce of each of the test patterns M and C input via the optical sensor 14, to measure the positions of the starting points Xms and Xcs and the end points Xme and Xce of the respective test patterns in operation 104.

Next, a horizontal distance between the corresponding test patterns M and C are calculated by subtracting the starting points Xms of the first mono test pattern M from the starting point Xcs of the first color test pattern C. A horizontal alignment error Eh generated in different printheads is calculated by obtaining a difference between the calculated distance and a previously stored distance Scs−Sms between the test patterns M and C. When the above operation is repeated with respect to the n pairs of the printed mono test pattern M and the color test pattern C, and an average thereof is calculated, an average print horizontal alignment error (refer to Equation 2) by the nozzles 22 and 32 of the printheads 21 and 31 of the respective color ink cartridge 30 and the mono ink cartridge 20 in the inkjet printer is calculated in operation 105.

The widths Wm and Wc where the respective test patterns M and C and the scanned line D cross are calculated by subtracting the starting points Xms and Xcs from the end points Xme and Xce of the respective test patterns M and C. The width Wm_tri and Wc_tri of the triangles where the respective test patterns M and C and the dotted line D cross are calculated by subtracting the preset width Wret of the rectangle from the widths Wm and Wc (refer to Equation 3). Also, since one angle θ of the triangle of each of the test patterns M and C is previously set, the heights Hm and Hc of the triangles are calculated from the scanned dotted line D (refer to Equation 4). Thus, the vertical alignment error Ev between the mono test pattern M and the corresponding color pattern C is calculated (refer to Equation 5). When the above operation is repeated with respect to the n pairs of the printed mono test pattern M and the color test pattern C and an average thereof is calculated, an average print horizontal alignment error (refer to Equation 6) from the nozzles 22 and 32 of the printheads 21 and 31 of the respective color ink cartridge 30 and the mono ink cartridge 20 in the inkjet printer is calculated in operation 106.

Next, to calibrate the measured horizontal and vertical alignment errors between the different printheads, the color ink cartridge 30 is calibrated with respect to the mono ink cartridge 20. Also, the mono ink cartridge 20 can be calibrated with respect to the color ink cartridge 30. To calibrate the horizontal alignment error, an ink injection time of the nozzle 32 of the color ink cartridge C is adjusted to reflect the time corresponding to the error. Also, according to the horizontal alignment error, an image of a print file printed by the color ink cartridge 30 and provided to print from an outside source can be shifted in operation 107.

In the meantime, in order to calibrate the vertical alignment error, an image of the color ink cartridge of the print file provided to the print can be shifted corresponding to the horizontal alignment error.

Although the vertical alignment error is measured after the horizontal alignment error is measured in the above embodiment, the measurements of the horizontal alignment error and the vertical alignment error are separately performed or the order may be changed.

In the above embodiment, a color inkjet printer having two ink cartridges are described. However, in an inkjet printer having three or more ink cartridges, it is possible to calibrate errors in the above method by selecting a reference ink cartridge and one of the other ink cartridges. Also, the above method can be applied to an inkjet printer using two mono ink cartridges.

As described above, according to the method of calibrating a print alignment error of an inkjet printer according to the present invention, the vertical and horizontal print alignment errors between different printheads can be automatically and conveniently calibrated. Furthermore, there is no need to use an expensive high resolution optical sensor.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of calibrating a print alignment error between a first printhead of a first ink cartridge and a second printhead of a second ink cartridge installed in an inkjet printer, the method comprising:

printing a first preset test pattern using the first printhead and a second preset test pattern using the second printhead, on a paper according to an input correction signal, the first and second test patterns having first and second starting points and first and second end points, respectively;

scanning the printed first and second test patterns;

measuring positions of the first and second starting points and the first and second end points of the scanned first and second test patterns;

calculating a horizontal print alignment error between the first and second printheads from the positions of the first and second starting points of the scanned first and second test patterns;

calculating a vertical print alignment error between the first and second printheads from a first distance between the positions of the first starting and end points of the first test pattern and a second distance between the positions of the second starting and end points of the second test pattern; and calibrating the calculated horizontal and vertical print alignment errors, wherein the operation of calculating the horizontal print alignment error comprises:

subtracting the starting point of the first test pattern by the first ink cartridge from the starting point of the second test pattern printed by the second ink cartridge; and calculating the horizontal print alignment error from a difference between a value, which is calculated in the operation of subtracting the first starting point of the first test pattern printed by the first ink cartridge from the second starting point of the second test pattern printed by the second ink cartridge, and a preset distance between the first test pattern and the second test pattern, wherein the first and second test patterns comprise n units of first sub-test patterns and n units of second sub-test pattern, respectively, in the operation of printing preset test patterns printing the n units of the first sub-test patterns using the first printhead and then the n units of the second sub-test patterns using the second printhead on the same swath of the paper, and the operation of calculating the horizontal print alignment error comprises calculating an average horizontal print alignment error with respect to n pairs of the first and second sub-test patterns by repeating the operations of subtracting the first starting point of each first sub-test pattern from the second starting point of each second sub-test pattern corresponding to the first sub-test pattern to calculate the horizontal print alignment error.

2. A method of calibrating a print alignment error between a first printhead of a first ink cartridge and a second printhead of a second ink cartridge installed in an inkjet printer, the method comprising:

printing a first preset test pattern using the first printhead and a second preset test pattern using the second printhead, on a paper according to an input correction signal, the first and second test patterns having first and second starting points and first and second end points, respectively;

scanning the printed first and second test patterns;

measuring positions of the first and second starting points and the first and second end points of the scanned first and second test patterns;

calculating a horizontal print alignment error between the first and second printheads from the positions of the first and second starting points of the scanned first and second test patterns;

calculating a vertical print alignment error between the first and second printheads from a first distance between the positions of the first starting and end points of the first test pattern and a second distance between the positions of the second starting and end points of the second test pattern; and calibrating the calculated horizontal and vertical print alignment errors, wherein the first and second test patterns each comprise a shape of a right triangle, wherein the first and second test patterns comprises a first triangle and a second triangle, respectively, and the operation of calculating the vertical print alignment error comprises:

calculating a width W2_tri of the second triangle formed by the starting point and the end point by subtracting the starting point from the end point of the second test pattern by the second ink cartridge;

calculating a height H2 of the second triangle using Equation 1 from the width W2_tri and a preset angle θ facing the width W2-tri of the second triangle $$H2=W2_tri/\tan\theta \quad \text{[Equation 1];}$$

calculating a width W1_tri of the first triangle formed by the starting point and the end point by subtracting the starting point from the end point of the first test pattern by the first ink cartridge;

calculating a height H1 of the first triangle using Equation 2 from the width W1_tri and the preset angle θ facing the width W1-tri of the first triangle $$H1=W1_tri/\tan\theta \quad \text{[Equation 2];}$$

and calculating the vertical print alignment error by subtracting the height H1 of the first triangle from the height H2 of the second triangle.

3. The method of claim 2, wherein, the operation of printing preset test patterns comprises printing the n units of the first sub-test patterns using the first printhead and then the n units of the second sub-test patterns using the second printhead, and the operation of calculating the vertical print alignment error comprises calculating an average vertical print alignment error with respect to n pairs of the first and second sub-test patterns by repeating the operations of calculating the width W2_tri of the second triangle, calculating the height H2 of the second triangle, calculating the width W1_tri of a first triangle, calculating the height H1 of the first triangle, and calculating the vertical print alignment error.

4. A method of calibrating a print alignment error between a first printhead of a first ink cartridge and a second printhead of a second ink cartridge installed in an inkjet printer, the method comprising:

printing a first preset test pattern using the first printhead and a second preset test pattern using the second printhead, on a paper according to an input correction signal, the first and second test patterns having first and second starting points and first and second end points, respectively;

scanning the printed first and second test patterns;

measuring positions of the first and second starting points and the first and second end points of the scanned first and second test patterns;

calculating a horizontal print alignment error between the first and second printheads from the positions of the first and second starting points of the scanned first and second test patterns;

calculating a vertical print alignment error between the first and second printheads from a first distance between the positions of the first starting and end points of the first test pattern and a second distance between the positions of the second starting and end points of the second test pattern; and calibrating the calculated horizontal and vertical print alignment errors, wherein the first and second test patterns each comprise a rectangle and a right triangle having the same height as the rectangle, and one side of the triangle having the same height as a vertical side of the rectangle is connected to the vertical side of the rectangle, wherein the operation of calculating the vertical print alignment error comprises:

calculating a width W2_tri of a second triangle by subtracting the starting point and a preset width of the rectangle from the end point of the first test pattern by the second ink cartridge;

calculating a height H2 of the second triangle using Equation 3 from the width W2_tri and a preset angle θ facing the width W2-tri of the second triangle $$H2=W2_tri/\tan\theta \quad \text{[Equation 3];}$$

calculating a width W1_tri of a first triangle by subtracting the starting point and a preset width of the rectangle from the end point of the first test pattern by the first ink cartridge;

calculating a height H1 of the first triangle using Equation 4 from the width W1_tri and a preset angle θ facing the width W1-tri of the first triangle $$H1=W1_tri/\tan\theta \quad \text{[Equation 4]};$$

and calculating a vertical print alignment error by subtracting the height H1 of the first triangle from the height H2 of the second triangle.

5. The method of claim 4, wherein the test patterns comprise n units of first sub-test patterns and n units of second sub-patterns, respectively, the operation of printing preset test patterns, comprises printing the n units of the first sub-test patterns using the first printhead and then the n units of test patterns using the second printhead on the same swath of the paper, and the operation of calculating the vertical print alignment error comprises calculating an average vertical print alignment error with respect to n pairs of the first and second sub-test patterns by repeating the operations of calculating a width W2_tri of the second triangle, calculating a height H2 of the second triangle, calculating a width W1_tri of the first triangle, calculating a height H1 of the first triangle, and calculating a vertical print alignment error according to the widths W1-tri and W2-tri and the highs H1 and H2.

* * * * *